US007741600B2

(12) United States Patent
Wouters et al.

(10) Patent No.: US 7,741,600 B2
(45) Date of Patent: Jun. 22, 2010

(54) APPARATUS AND METHOD FOR PROVIDING IONS TO A MASS ANALYZER

(75) Inventors: Eloy R. Wouters, San Jose, CA (US); Maurizio Splendore, Walnut Creek, CA (US)

(73) Assignee: Thermo Finnigan LLC, San Jose, CA (US)

( * ) Notice: Subject to any disclaimer, the term of this patent is extended or adjusted under 35 U.S.C. 154(b) by 645 days.

(21) Appl. No.: 11/601,343

(22) Filed: Nov. 17, 2006

(65) Prior Publication Data

US 2008/0116371 A1 May 22, 2008

(51) Int. Cl.
*H01J 49/00* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS 5,432,343 A * 7/1995 Gulcicek et al. ..... 250/288
6,188,065 B1 2/2001 Takada et al.
6,903,334 B1 6/2005 Makarov et al.
6,953,928 B2 10/2005 Vestal et al.
2004/0108450 A1 * 6/2004 Makarov et al. ..... 250/281

* cited by examiner

*Primary Examiner*—David A Vanore
*Assistant Examiner*—Hanway Chang
(74) *Attorney, Agent, or Firm*—Sharon Upham; Charles B. Katz

(57) ABSTRACT

A method and apparatus for directing ions from an ionization source to a mass analyzer is provided. The method includes producing ions from a sample in an ionization source. Some of the ions are transferred to a first region via a passageway that is in fluid communication with the ionization source. Next, some of the ions are sampled from the first region into a second region via an aperture that is defined thorough a partition element. The aperture is centered about a longitudinal axis that passes through an ion transfer element within the second region. An electric field is established for deflecting some of the ions that pass through the aperture of the partition element. In particular, the electric field is directed transverse to the longitudinal axis such that relatively more ions enter an input end of the ion transfer element compared to when the ions are not deflected.

8 Claims, 8 Drawing Sheets

APPARATUS AND METHOD FOR PROVIDING IONS TO A MASS ANALYZER

FIELD OF THE INVENTION

The instant invention relates generally to atmospheric pressure ion sources that are coupled to mass analyzers, and more particularly to an apparatus and method for providing ions from an atmospheric pressure ion source into a mass analyzer.

BACKGROUND OF THE INVENTION

A number of different atmospheric pressure ionization (API) sources have been developed for producing ions from a sample at atmospheric pressure. One well-known and important example is the electrospray ionization (ESI) source. The electrospray ionization technique, and more specifically electrospray ionization sources interfaced to mass spectrometers, has opened a new era of study for the molecular weight determination of labile and involatile biological compounds. In electrospray ionization, singly or multiply charged ions in the gas phase are produced from a solution at atmospheric pressure. The mass-to-charge (m/z) ratio of the ions that are produced by electrospray ionization depends on the molecular weight of the analyte and the solution chemistry conditions. Fenn et al. in U.S. Pat. No. 5,130,538 describes extensively the production of singly and multiply charged ions by electrospray ionization at atmospheric pressure.

Briefly, the electrospray process consists of flowing a sample liquid through a small tube or needle, which is maintained at a high voltage relative to a nearby surface. The voltage gradient at the tip of the needle causes the liquid to be dispersed into fine electrically charged droplets. Under appropriate conditions the electrospray resembles a symmetrical cone consisting of a very fine mist of droplets of ca. 1 μm in diameter. Excellent sensitivity and ion current stability is obtained if a fine mist is produced. Unfortunately, the electrospray "quality" is highly dependent on the bulk properties of the solution that is being analyzed, such as for instance surface tension and conductivity. The ionization mechanism involves desorption at atmospheric pressure of ions from the fine electrically charged particles. In many cases a heated gas is flowed so as to enhance desolvation of the electrosprayed droplets. The ions created by the electrospray process are then mass analyzed using a mass analyzer.

In U.S. Pat. No. 5,171,990 there is described an electrospray ion source of the type which includes an ion transfer tube communicating between the ionizing region and a low-pressure region with a skimmer having an aperture through which ions pass. The skimmer separates the low-pressure region from a progressively lower pressure region, which includes ion focusing lenses and an analyzer. The ion transfer tube is oriented so that undesolvated droplets or particles traveling through the tube are prevented from passing through the skimmer aperture into the analysis region. In particular, the axis of the ion transfer tube is altered or directed so that the axis is offset from the skimmer aperture. In this way, there is no alignment between the bore of the tube and the skimmer aperture. The tendency is for the large droplets or particles to move to the center of the flow in the ion transfer tube and travel in a straight line. These droplets or particles traveling in a straight line strike the skimmer. The droplets or particles are thereafter pumped away. Additionally, a tube lens is provided adjacent to the outlet end of the ion transfer tube for focusing and/or diverting ions toward the skimmer aperture. Unfortunately, since the ions follow an off-axis trajectory through the skimmer aperture there is a tendency for some of the ions to continue along a trajectory terminating at a surface of an ion transfer element adjacent the exit side of the skimmer. Over time, a burn/deposit becomes apparent on the surface of the ion transfer element that is opposite the ion transfer tube. This effect reduces the throughput of the ion source, and thereby reduces the overall sensitivity of the instrument.

Accordingly, there is a need for a system that increases the throughput of the ion source while at the same time maintaining low chemical background noise.

SUMMARY OF THE INVENTION

According to an aspect of the instant invention there is provided a mass spectrometer system, comprising: an ionization source for forming ions from a sample; a passageway for transporting ions from the ionization source to a first region, the passageway extending along a first longitudinal axis; a partition element separating the first region from a second region, the partition element having an aperture communicating from the first region to the second region for transmitting the ions from the first region to the second region; a mass analyzer, disposed in a high vacuum region, for measuring the mass-to-charge ratios of at least a portion of the ions, the mass analyzer and the aperture of the partition element lying along a second longitudinal axis that is offset from or at an angle to the first longitudinal axis; an ion transfer element disposed between the partition element and the mass analyzer, the ion transfer element having an input end for receiving ions that have passed through the aperture of the partition element; and, a first ion-deflector disposed between the passageway and the ion transfer element, the first ion-deflector for establishing a first electric field for deflecting ions toward a path approximately along the second longitudinal axis and passing through the input end of the ion transfer element.

According to an aspect of the instant invention, there is provided an ion transfer assembly for directing ions from an ionization source to a mass analyzer, comprising: a partition element separating a first region from a second region, the partition element having an aperture communicating from the first region to the second region for transmitting ions from the first region to the second region; an ion transfer element disposed within the second region, the ion transfer element having an input end for receiving ions that have passed through the aperture of the partition element; and, an ion-deflector disposed between the partition element and the ion transfer element, the ion deflector for establishing an electric field for deflecting the ions toward the input end of the ion transfer element.

According to an aspect of the instant invention, there is provided an ion transfer assembly for directing ions from an ionization source to a mass analyzer, comprising: a partition element for separating a first region from a second region, the partition element comprising: an aperture communicating from the first region to the second region for transmitting ions therebetween, the center of the aperture lying along a longitudinal axis passing through the mass analyzer; and, two electrode surfaces that are electrically isolated one from the other, the two electrode surfaces disposed in a facing relationship one relative to the other and such that the longitudinal axis passes therebetween; and, an ion transfer element disposed within the second region, the ion transfer element having an input end for receiving ions that have passed through the aperture of the partition element, wherein application of a potential difference between the two electrode surfaces of the partition element results in an electric field being established for deflecting the ions toward the input end of the ion transfer element.

According to an aspect of the instant invention, there is provided a method for directing ions from an ionization source to a mass analyzer, comprising: producing ions in an ionization source from a sample material; transferring some of the ions from the ionization source to a first region via a passageway that is in fluid communication with the ionization source; sampling some of the ions from the first region into a second region via an aperture that is defined thorough a partition element, the aperture centered about a longitudinal axis that passes through an ion transfer element within the second region; and, deflecting ions that pass through the aperture of the partition element by establishing an electric field that is directed transverse to the longitudinal axis, such that relatively more ions enter an input end of the ion transfer element compared to when the ions are not deflected.

BRIEF DESCRIPTION OF THE DRAWINGS

Exemplary embodiments of the invention will now be described in conjunction with the following drawings, in which similar reference numerals designate similar items.

DESCRIPTION OF EMBODIMENTS OF THE INSTANT INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

Figure 1:
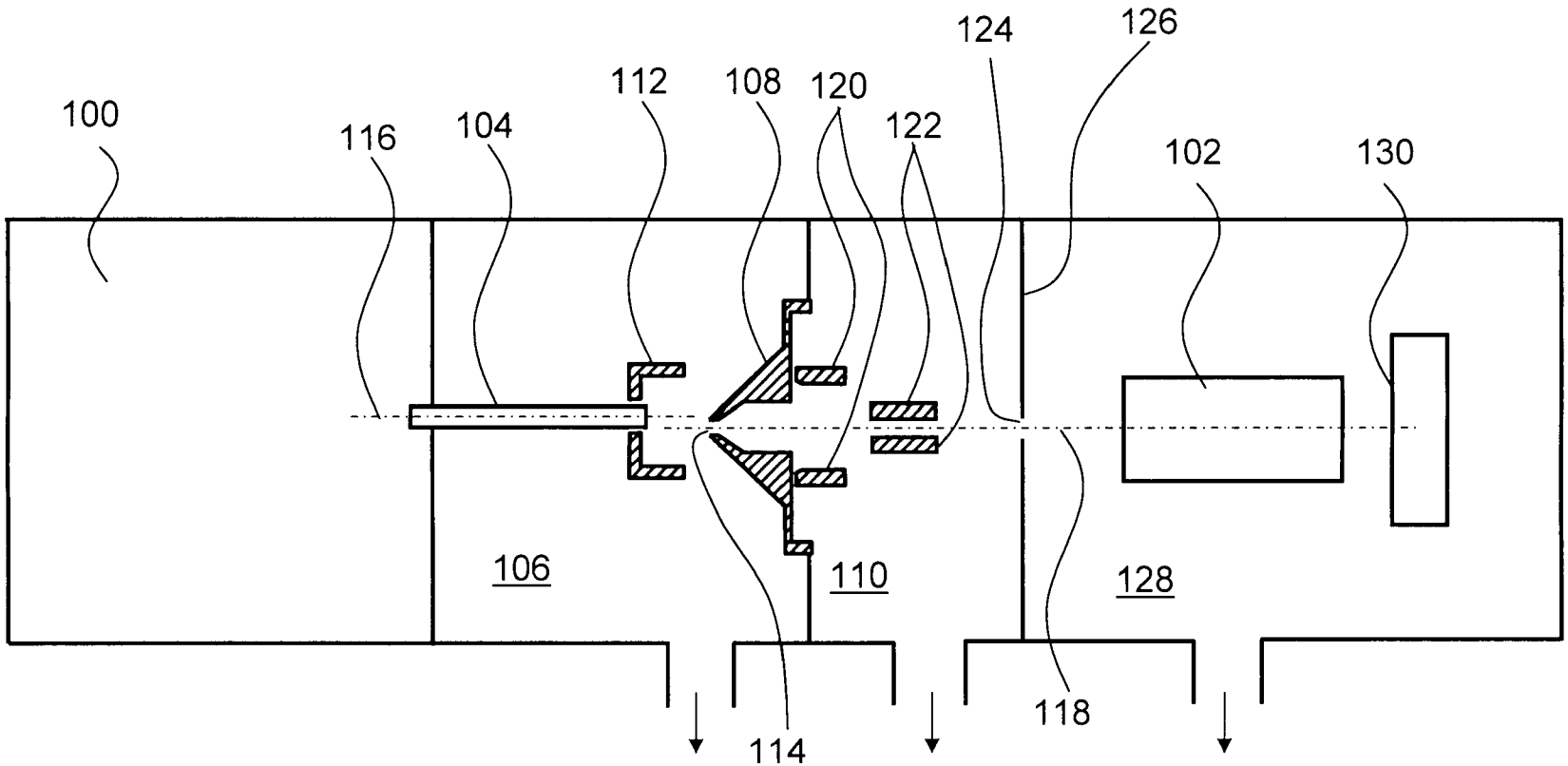
FIG. 1 is a simplified schematic diagram showing an atmospheric pressure ionization (API) source coupled to an analyzing region via an ion transfer tube.

Referring to FIG. 1, shown is a simplified schematic diagram of an atmospheric pressure ionization (API) source coupled to an analyzing region via an ion transfer tube. An API source 100 is connected to receive a liquid sample from an associated apparatus such as for instance a liquid chromatograph or syringe pump. The API source 100 optionally is an electrospray ionization (ESI) source, a heated electrospray ionization (H-ESI) source, an atmospheric pressure chemical ionization (APCI) source, an atmospheric pressure matrix assisted laser desorption source, a photoionization source, or a source employing any other ionization technique that operates at pressures substantially above the operating pressure of mass analyzer 102 (e.g., from about 1 torr to about 2000 torr). Furthermore, the term API source is intended to include a "multi-mode" source combining a plurality of the above-mentioned source types. The API source 100 forms ions representative of the sample, which ions are transported from the API source 100 to the mass analyzer 102 via an ion transfer assembly. In particular, the ions are entrained in a background gas and transported from the API source 100 through an ion transfer tube 104 into a first region 106 which is maintained at a lower pressure (e.g., 0.5 to 10 torr) than the atmospheric pressure of the API source 100 (for instance, a viscous flow region). Due to the differences in pressure, ions and gases are caused to flow through ion transfer tube 104 into the first region 106, where the ions and gases expand to form a supersonic free jet. The end of the ion transfer tube 104 is opposite a plate or partition element 108 (that can take the form of a skimmer) that separates the first region 106 from a second region 110, which is maintained at a lower pressure (e.g., from about 2 to about 400 millitorr) than first region 106 (for instance, a transition flow region). A tube lens 112, which may be considered to be a first ion-deflector, surrounds the end of ion transfer tube 104 and provides an electrostatic field that focuses the ion stream leaving ion transfer tube 104 through an aperture 114 in skimmer 108. As shown in FIG. 1, a first longitudinal axis 116 is defined along the length of a passageway through ion transfer tube 104, and is offset from a second longitudinal axis 118 that passes through the mass analyzer 102 and the aperture 114. A gas dynamic focusing element 120 is disposed adjacent to the back-side of skimmer 108, for focusing the ions and gasses that pass through aperture 114 into the input end of an ion transfer element 122. The ion transfer element 122, such as for instance a multipole ion guide, directs the ions through aperture 124 in a second partition element 126 and into the mass analyzer 102 disposed in high vacuum region 128, and, ultimately, to detector 130 whose output can be displayed as a mass spectrum.

Optionally, the gas dynamic focusing element 120 is formed integrally with the partition element or skimmer 108. Optionally, ion transfer element 122 includes additional skimmers, ion transfer tubes, lenses, RF-only optics, such as RF quadrupoles, other multipoles or other ion-optical devices such as DC lenses or Einzel lenses. Further optionally, mass analyzer 102 is any mass analyzer or hybrid combination of mass analyzers, including quadrupole mass analyzers, ion trap mass analyzer (including 3D or linear 2D ion traps), time of flight mass analyzers, Fourier transform mass analyzers, sector mass analyzers, electrostatic mass analyzers, or the like.

Figure 2:
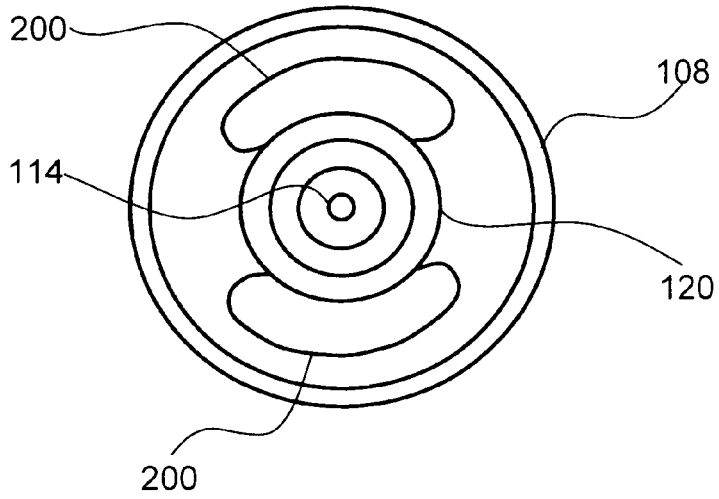
FIG. 2 is a plan view showing the back-side of the skimmer of FIG. 1.

Referring now to FIG. 2, shown is a plan view of the back-side of the skimmer of FIG. 1. In the instant example, the back-side of the skimmer 108 is contoured, being formed with grooves 200 (see also FIG. 10) to allow for just enough pumping so as not to allow a molecular gas beam to subsequently enter the high vacuum region 128, but to restrict the evacuation of background gases so as to allow for the influence of gas flow focusing to occur, as described in U.S. Pat. No. 6,872,940.

Figure 3:
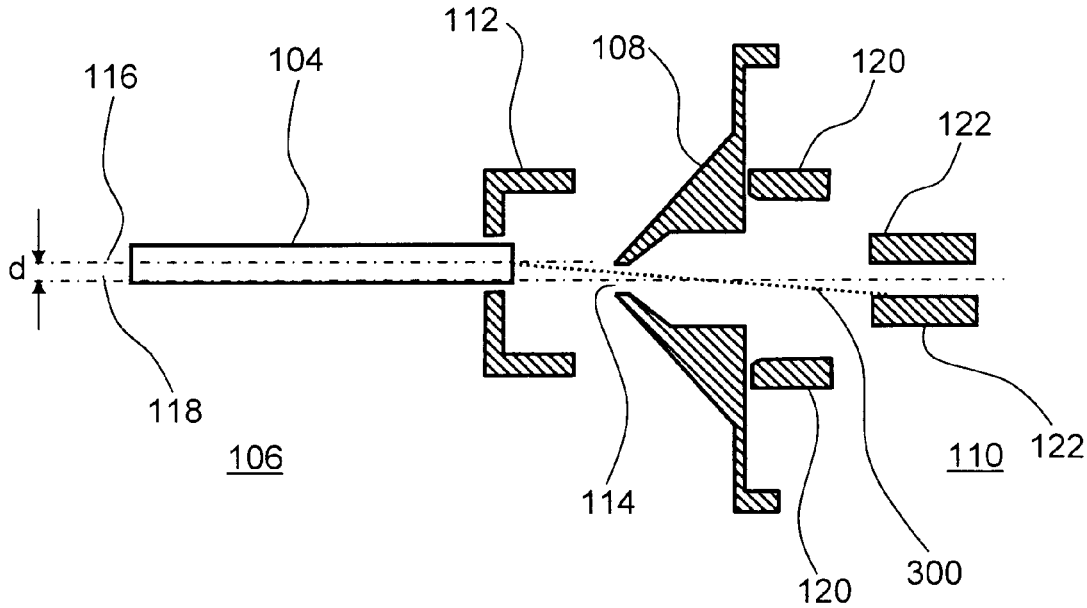
FIG. 3 is an enlarged view of the first and second regions of the apparatus of FIG. 1.

Referring now to FIG. 3, shown is an enlarged view of the first and second regions of the apparatus of FIG. 1. As discussed supra the first longitudinal axis 116 is offset from the second longitudinal axis 118, in this example the offset distance is denoted "d". Offsetting the ion transfer tube 104 from the aperture 114 ensures that large droplets and particles near the center of the flow in the ion transfer tube 104 do not pass through aperture 114 of skimmer 108. Tube lens 112 produces an electric field, which focuses the ions through the aperture 114 and toward mass analyzer 102. As is shown in FIG. 3, some of the ions follow a trajectory that impacts on the inside surface of ion transfer element 122. One such trajectory is identified in FIG. 3 using the reference numeral 300. Over time, a burn or deposit is formed on the surface of ion transfer element 122 that is opposite the offset ion transfer tube 104.

Figure 4:
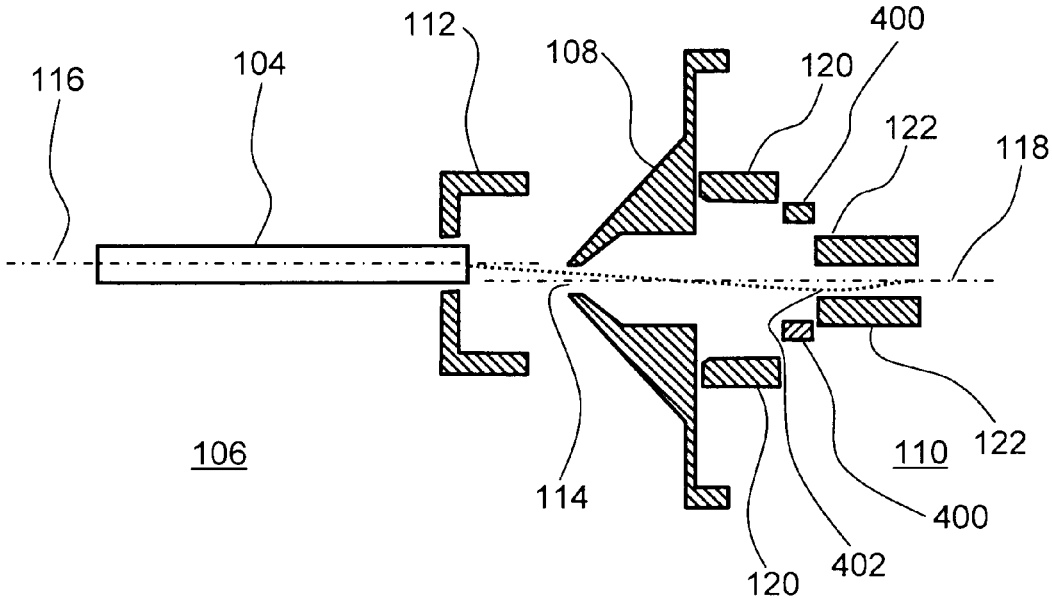
FIG. 4 is an enlarged view of the first and second regions of an apparatus according to an embodiment of the instant invention, including a plurality of steering electrodes.

Referring now to FIG. 4, shown is an enlarged view of the first and second regions of an apparatus according to an embodiment of the instant invention, including a plurality of steering electrodes. The plurality of steering electrodes 400, which may be considered to be a second ion-deflector, are provided between the gas dynamic focusing element 120 and the ion transfer element 122. Application of a potential difference between the steering electrodes 400 results in an electric field. Ions passing through the electric field between the gas dynamic focusing element 120 and the ion transfer element 122 are steered or deflected away from the surface of ion transfer element 122 and back toward the second longitudinal axis 118, along trajectory 402 in FIG. 4. By controlling the potential difference between the steering electrodes 400, ion throughput of the source is optimized and damage or contamination of the ion transfer element 122 is reduced. The steering electrodes 400 are electrically isolated one from another, and from other components including the ion transfer element 122 and the gas dynamic focusing element 120.

Figure 5:
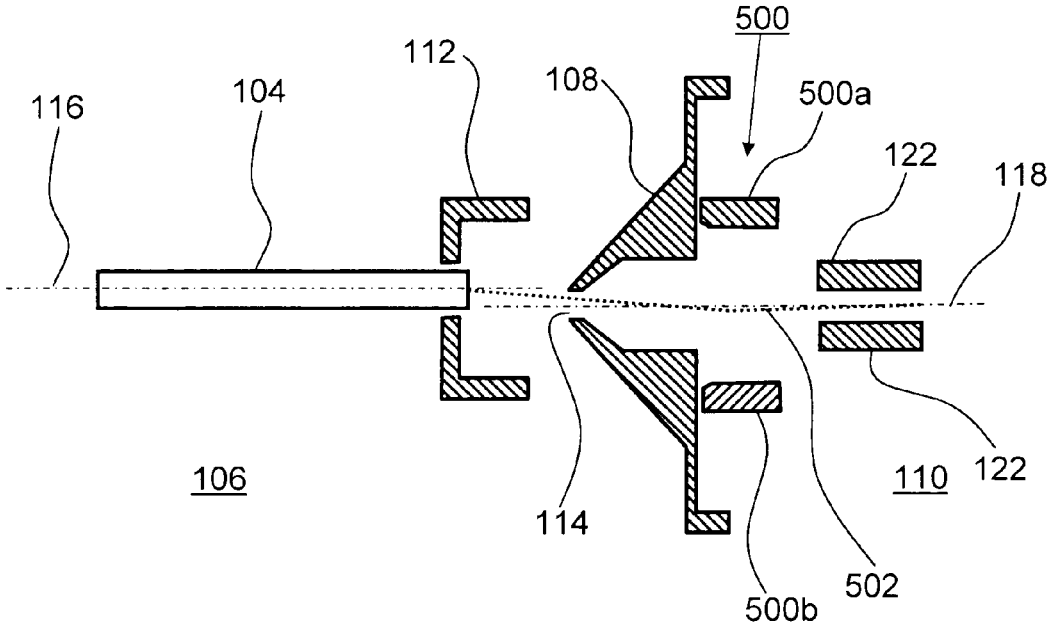
FIG. 5 is an enlarged view of the first and second regions of an apparatus according to an embodiment of the instant invention, including a split skirt-electrode assembly.

Referring now to FIG. 5, shown is an enlarged view of the first and second regions of an apparatus according to an embodiment of the instant invention, including a split skirt-electrode assembly. In FIG. 5, the gas dynamic focusing element is split into two separate portions, 500*a* and 500*b*, and is referred to collectively as split-skirt electrode assembly 500, which may be considered to be a second ion-deflector. The split-skirt electrode assembly 500 is electrically isolated from skimmer 108, and the two separate portions 500*a* and 500*b* are also electrically isolated one from the other. Application of a potential difference between the two portions 500*a* and 500*b* results in an electric field being established. Ions passing through the electric field within the split-skirt electrode assembly 500 are steered or deflected away from the surface of ion transfer element 122 and back toward the second longitudinal axis 118, along trajectory 502 in FIG. 5. By controlling the potential difference between the two portions 500*a* and 500*b* of the split-skirt electrode assembly 500, ion throughput of the source is optimized and damage or contamination of the ion transfer element 122 is reduced.

Figure 6:
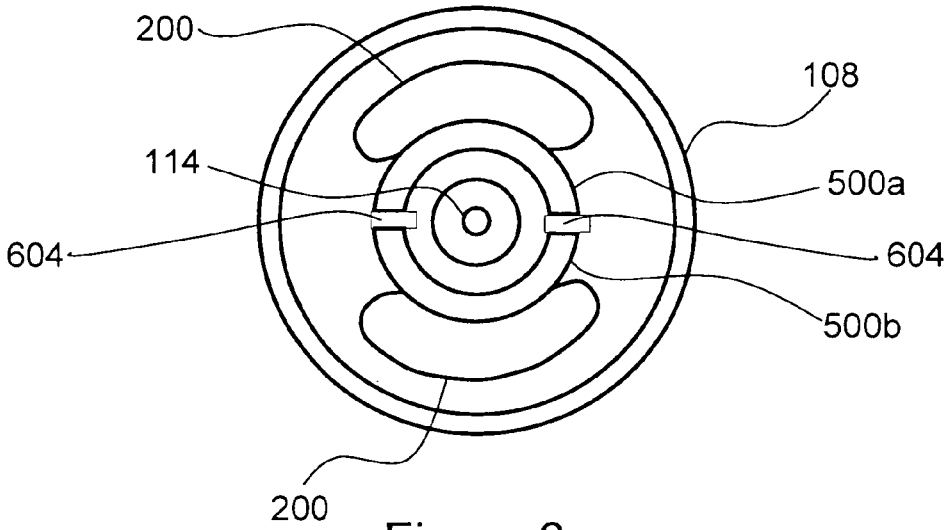
FIG. 6 is a plan view showing a split skirt-electrode assembly adjacent to the back-side of the skimmer of FIG. 5.

Referring now to FIG. 6, shown is a plan view of the split skirt-electrode assembly adjacent to the back-side of the skimmer of FIG. 5. In the instant example, the two portions 500*a* and 500*b* of the split-skirt electrode assembly 500 are formed of a cylindrical tube that is bisected along the longitudinal direction. The two portions 500*a* and 500*b* of the split-skirt electrode assembly 500 are separated by gaps 604, which contain an electrically insulating material such as for instance one of polyetheretherketone (PEEK) or Kapton® tape.

Figure 7A:
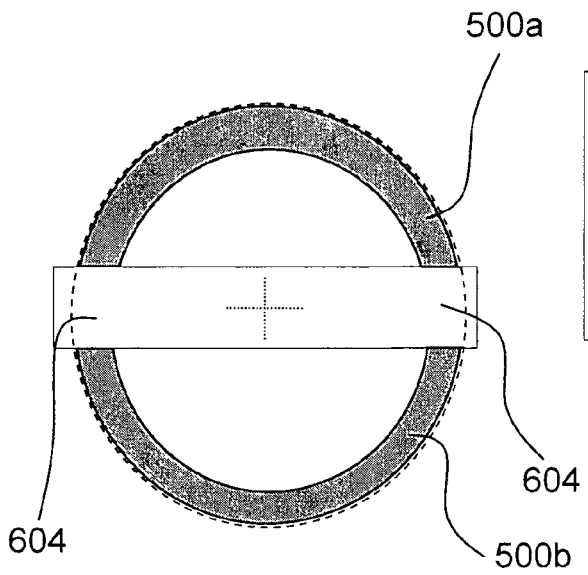
FIG. 7*a* shows the split skirt-electrode configuration of FIGS. 5 and 6.
Figure 7B:
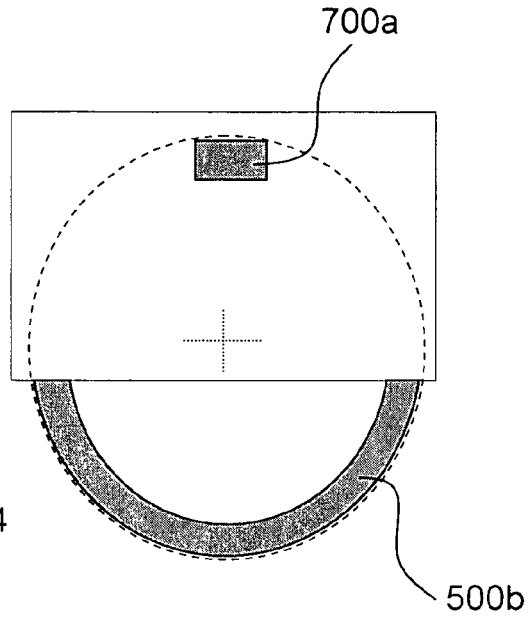
FIG. 7*b* shows a first alternative split skirt-electrode configuration.
Figure 7C:
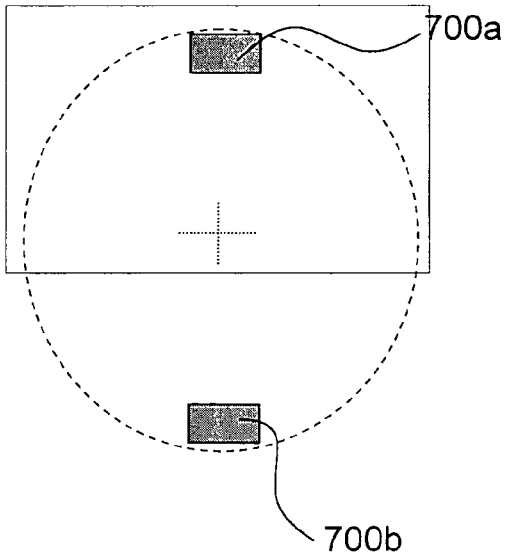
FIG. 7*c* shows a second alternative split skirt-electrode configuration.
Figure 7D:
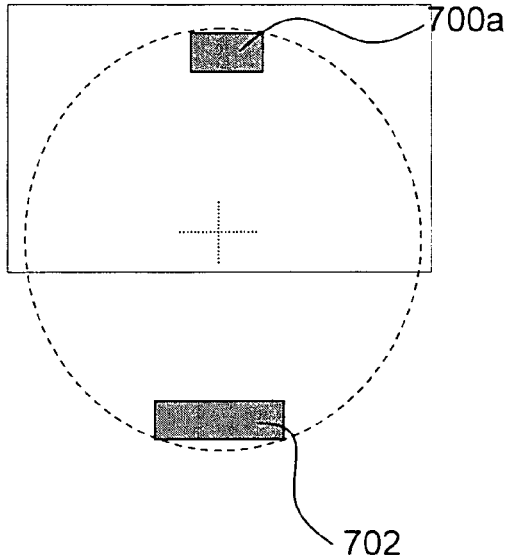
FIG. 7*d* shows a third alternative split skirt-electrode configuration.

The split skirt-electrode assembly 500 that is shown in FIGS. 5 and 6, and that is also reproduced in FIG. 7*a*, is intended merely to serve as a specific and non-limiting example. Several alternative split skirt-electrode assembly configurations are shown in FIGS. 7*b*-7*d*. Referring specifically to FIG. 7*b*, shown is a first alternative split skirt-electrode configuration. In the first alternative configuration, a planar electrode body 700*a* replaces the half-cylindrical portion 500*a*. Referring now to FIG. 7*c*, shown is a second alternative split skirt-electrode configuration. In the second alternative configuration, a planar electrode body 700*b* also replaces the half-cylindrical portion 500*b*. Referring now to FIG. 7*d*, shown is a third alternative split skirt-electrode configuration. As shown in FIG. 7*d*, the two planar electrode bodies 700*a* and 702 optionally are of different size. In each of FIGS. 7*a* through 7*d*, the cross in the middle of the figure represents the location of the second longitudinal axis, and the dotted circle represents the outside diameter of the gas dynamic focusing element 120 of FIGS. 1-4. Of course, without modifying the back-side of the skimmer 108, the two portions of the split-skirt assembly are constrained to be within the dotted circle, but optionally one or both of the two portions is disposed closer to the longitudinal axis. Further optionally, the split-skirt electrode assembly comprises more than two portions, and/or comprises a plurality of electrode portions alternating with a plurality of electrically insulating portions, etc.

Figure 8:
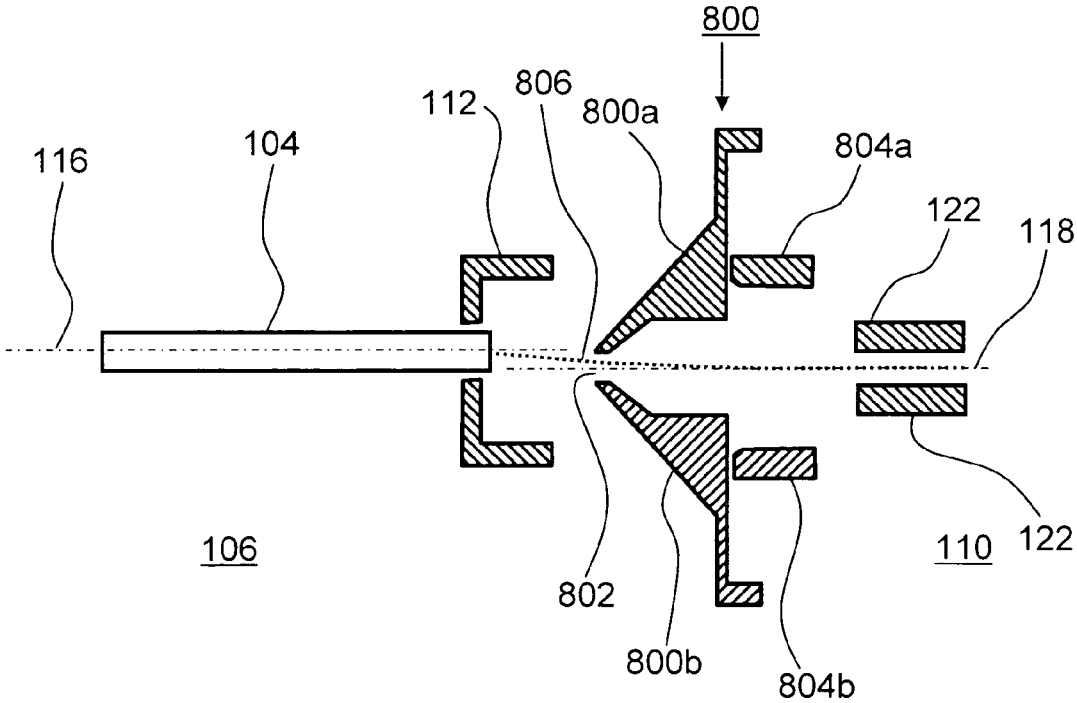
FIG. 8 is an enlarged view of the first and second regions of an apparatus according to an embodiment of the instant invention, including a split skimmer.

Referring now to FIG. 8, shown is an enlarged view of the first and second regions of an apparatus according to an embodiment of the instant invention, including a split skimmer. The split-skimmer 800, which may be considered to be a second ion-deflector, includes two separate portions 800*a* and 800*b*. The two separate portions 800*a* and 800*b*, when in an assembled condition, cooperate to form a skimmer with a generally cone-shaped protrusion that is directed into the first region, and that terminates at a tip defining an aperture 802. The two portions 800*a* and 800*b* are electrically isolated one from the other. A gas dynamics focusing element is integrally formed with the skimmer, each of the two separate portions 800*a* and 800*b* including one portion 804*a* and 804*b*, respectively, of the gas dynamics focusing element.

Application of a potential difference between the two portions 800*a* and 800*b* results in an electric field being established. Ions passing through the electric field within the split-skimmer 800 are steered or deflected away from the surface of ion transfer element 122 and back toward the second longitudinal axis 118, along trajectory 806 in FIG. 8. By controlling the potential difference between the two portions 800*a* and 800*b* of the split-slimmer 800, ion throughput of the source is optimized and damage or contamination of the ion transfer element 122 is reduced.

Figure 9:
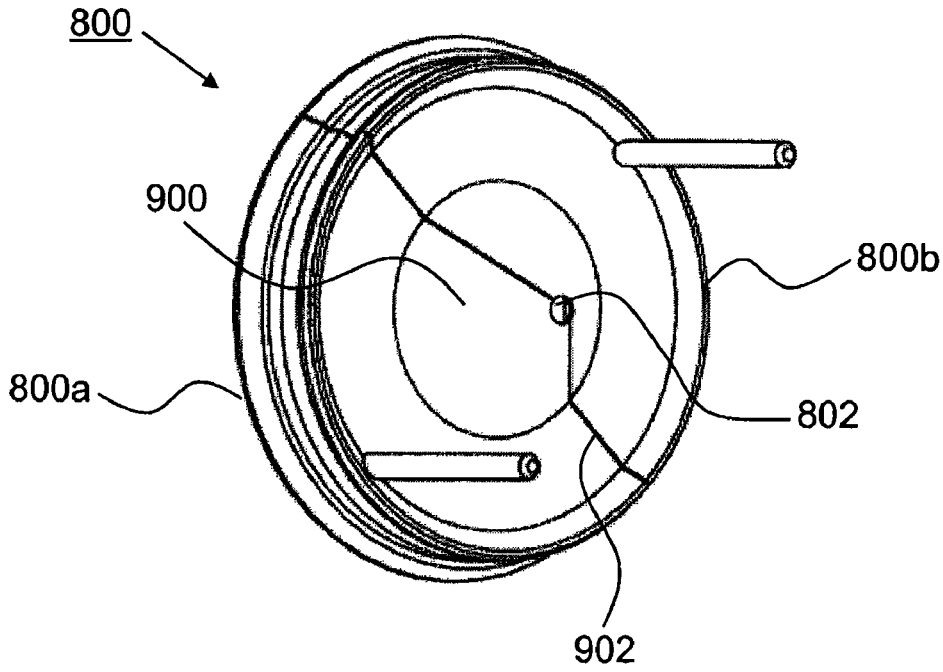
FIG. 9 illustrates the front surface of the split-skimmer of FIG. 8.

Referring now to FIG. 9, shown is the front surface of the split-skimmer of FIG. 8. As discussed supra the split-skimmer 800 is formed of two portions, 800*a* and 800*b*, which are separated by a small gap 902. For instance, the two portions 800*a* and 800*b* are obtained from a one-piece skimmer by electrical discharge machining (EDM) removal of ~0.0127 cm (~0.005") along a line that bisects the one-piece skimmer. As is shown in FIG. 9, the EDM cutting tool is guided along one side of the generally cone-shaped protrusion 900, to the aperture 802, and then along the opposite side of the generally cone-shaped protrusion 900. The two separate pieces obtained by EDM are kept as a matched pair 800*a* and 800*b*. When in an assembled condition, an electrically insulating material is disposed within the gap 902 between the two portions 800*a* and 800*b*. For instance, the gap 902 is filled in by two layers of double sided Kapton® tape of ~0.0051 cm (~0.002") thickness.

Figure 10:
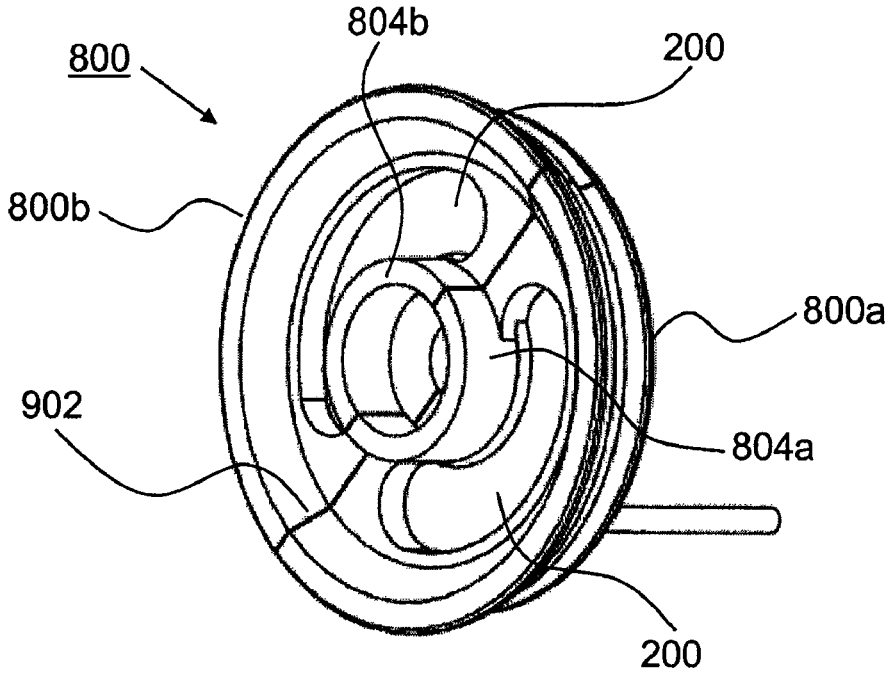
FIG. 10 illustrates the back surface of the split-skimmer of FIG. 8.

Referring now to FIG. 10, shown is the back surface of the split-skimmer of FIG. 8. Each of the two portions 800*a* and 800*b* includes one portion of the gas dynamics focusing element, 804*a* and 804*b*, respectively. The electrically insulating material extends to fill the gap 902 between the portions 802*a* and 802*b* of the gas dynamic focusing element.

Figure 11:
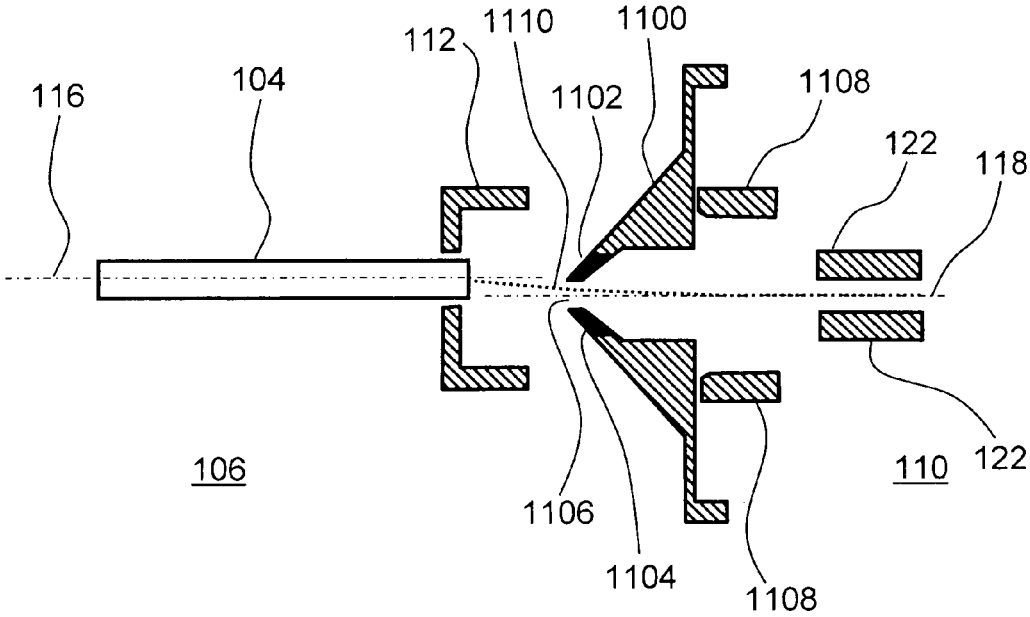
FIG. 11 is an enlarged view of the first and second regions of an apparatus according to an embodiment of the instant invention, including a skimmer having a plurality of plated regions.

Referring now to FIG. 11, shown is an enlarged view of the first and second regions of an apparatus according to an embodiment of the instant invention, including a skimmer having a plurality of plated regions. In FIG. 11, the skimmer 1100 is formed of an electrically insulating material, such as for instance a ceramic material. A plurality of electrode surfaces, including electrode surfaces 1102 and 1104, are plated onto the skimmer 1100. For instance, the electrode surfaces 1102 and 1104 are metal plated regions of the skimmer 1100 and may be considered collectively to be a second ion-deflector. The electrode surfaces 1102 and 1104 are electrically isolated one from the other. In FIG. 11, an aperture 1106 is defined between the electrode surfaces 1102 and 1104, near the tip of the generally cone-shaped protrusion of the skimmer 1100. Furthermore, a gas dynamic focusing element 1108 is provided adjacent the back-side of skimmer 1100. Optionally, the gas dynamic focusing element 1108 is formed separately from the skimmer 1100 and is disposed in an adjacent, spaced-apart relationship therewith. Application of a potential difference between the electrode surfaces 1102 and 1104 results in an electric field being established. Ions passing through the electric field within the skimmer 1100 are steered or deflected away from the surface of ion transfer element 122 and back toward the second longitudinal axis 118, along trajectory 1110 in FIG. 11. By controlling the potential difference between the electrode surfaces 1102 and 1104 of the skimmer 1100, ion throughput of the source is optimized and damage or contamination of the ion transfer element 122 is reduced. Optionally, a number of plated regions greater than two is provided on the skimmer 1100.

Figure 12:
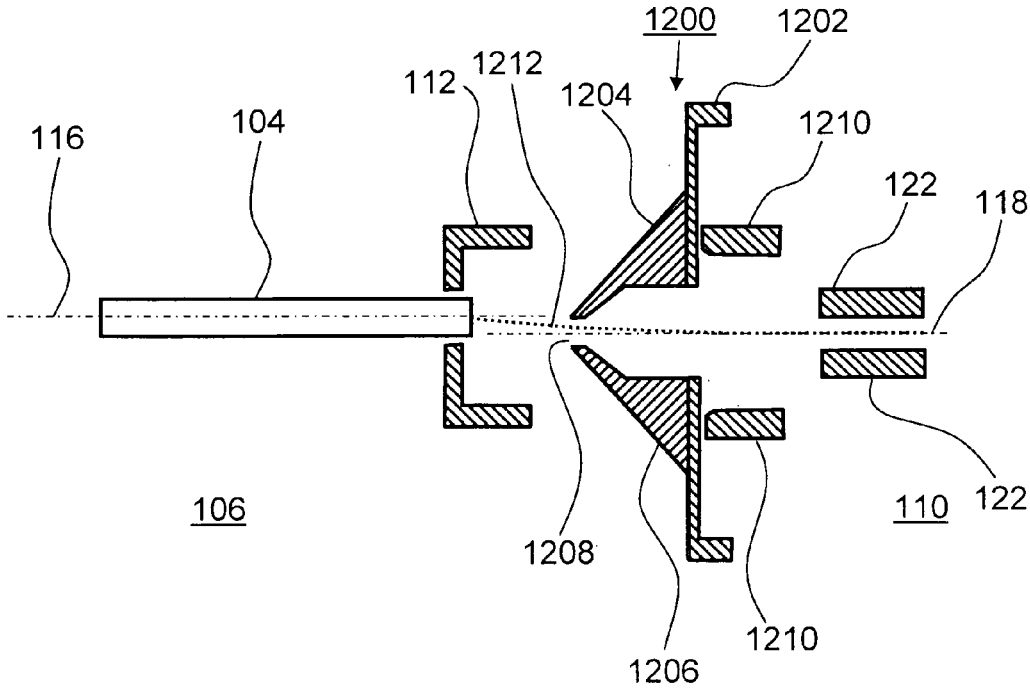
FIG. 12 is an enlarged view of the first and second regions of an apparatus according to an embodiment of the instant invention, including an electrically insulating holding plate and a plurality of conductive inserts; and, FIG. 13 is a simplified flow diagram of a method for directing ions from an ionization source to a mass analyzer.

Referring now to FIG. 12, shown is an enlarged view of the first and second regions of an apparatus according to an embodiment of the instant invention, including an electrically insulating holding plate and a plurality of conductive inserts. In FIG. 12, the skimmer 1200 is formed of an electrically insulating holding plate 1202 that is mounted into a partition between the first region 106 and the second region 110. For instance, the electrically insulating holding plate 1202 is formed of a ceramic material or is formed of PEEK. The holding plate 1202 receives a first end of each of a plurality of conductive inserts 1204 and 1206, which collectively may be considered to be a second ion-deflector. The second end of each of the plurality of conductive inserts 1204 and 1206 cooperate to form the generally cone-shaped protrusion of the skimmer 1200, directed into the first region 106 and terminating at a tip that defines an aperture 1208. An electrically insulating material is disposed between facing surfaces of the conductive inserts 1204 and 1206, so as to electrically isolate the inserts one from the other. Furthermore, a gas dynamic focusing element 1210 is provided adjacent the back-side of holding plate 1202. Optionally, the gas dynamic focusing element 1210 is formed separately from the holding plate 1202 and is disposed in an adjacent, spaced-apart relationship therewith. Application of a potential difference between the conductive inserts 1204 and 1206 results in an electric field being established. Ions passing through the electric field within the skimmer 1200 are steered or deflected away from the surface of ion transfer element 122 and back toward the second longitudinal axis 118, along trajectory 1212 in FIG. 12. By controlling the potential difference between the conductive inserts 1204 and 1206 of the skimmer 1200, ion throughput of the source is optimized and damage or contamination of the ion transfer element 122 is reduced.

The preceding discussion has considered several specific examples, in each of which the ion transfer tube 104 is offset from the second longitudinal axis. Optionally, the ion transfer tube 104 is set at an angle to the second longitudinal axis (between ~0° to ~90°) such that there is not a direct line of sight between the ion transfer tube 104 and the mass analyzer 102. In each of the preceding examples, it has also been assumed that any additional wiring that is required for applying potential differences between electrode surfaces is provided in such a way that pumping of the various stages of the apparatus is not affected. Throughout the foregoing discussion and in the claims that follow, the labels "first" and "second" are used to refer conveniently to the various ion-deflecting elements of a mass spectrometer system, such as for instance the tube lens 112 as well as the various structures that include the steering electrodes 400, the split-skirt electrode assembly 500, the split-skimmer 800, etc. When considering the ion transfer assembly in isolation, the tube lens 112 may be omitted from the discussion such that the various structures that include the steering electrodes 400, the split-skirt electrode assembly 500, the split-skimmer 800, etc. may be referred to simply as an ion-deflector.

Figure 13:
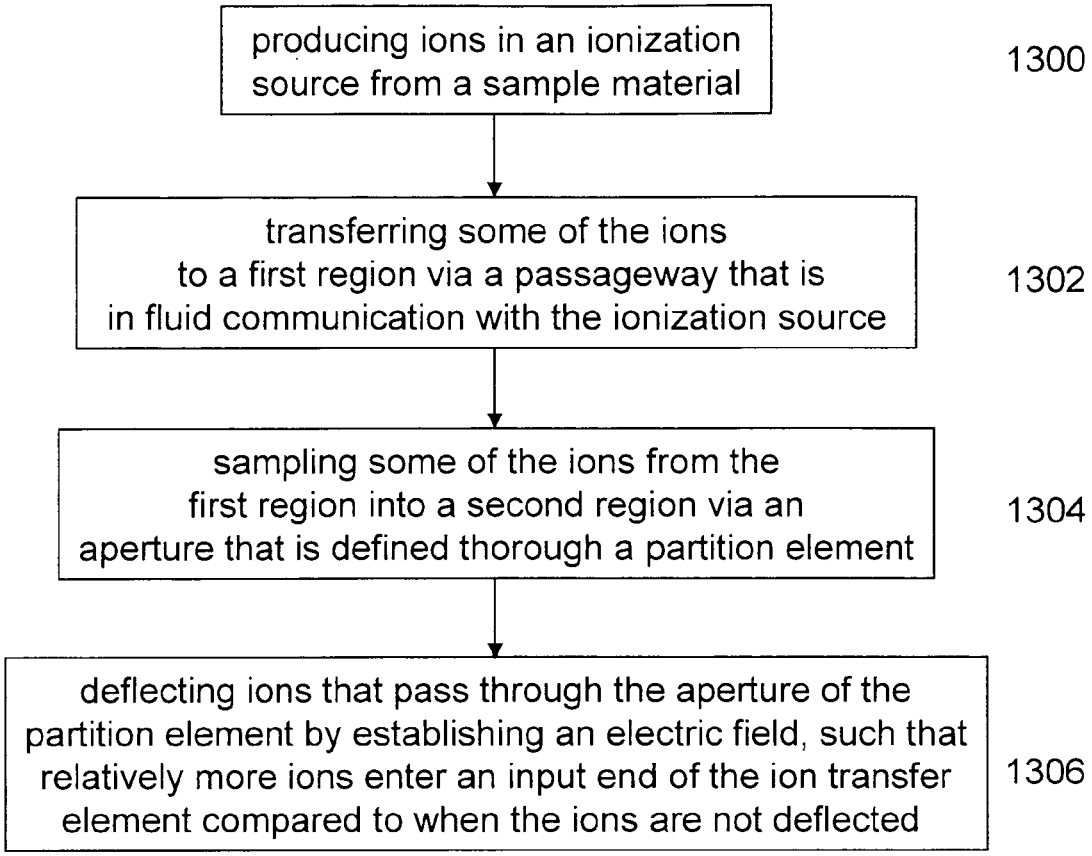

Referring now to FIG. 13, shown is a simplified flow diagram of a method for directing ions from an ionization source to a mass analyzer. At step 1300 ions are produced from a sample in an ionization source containing a background gas. At step 1302 some of the ions are transferred to a first region via a passageway that is in fluid communication with the ionization source. At step 1304 some of the ions are sampled from the first region into a second region via an aperture that is defined thorough a partition element. In particular, the aperture is centered about a longitudinal axis that passes through an ion transfer element within the second region, the longitudinal axis being offset from or at an angle to another longitudinal axis that is directed along the length of the passageway. At step 1306 an electric field is established for deflecting ions that pass through the aperture of the partition element, the electric field being directed transverse to the longitudinal axis that passes through the ion transfer element. In this way, relatively more ions enter an input end of the ion transfer element compared to when the ions are not deflected. The step of establishing an electric field includes applying a potential difference between two spaced-apart electrode surfaces. The two spaced-apart electrode surfaces are disposed one each on opposite sides of the longitudinal axis, so as to establish the electric field for deflecting ions. Optionally, the electric field is established at least partially within the second region and/or at least partially within the partition element.

Numerous other embodiments may be envisaged without departing from the spirit and scope of the invention.

What is claimed is:

1. A mass spectrometer system, comprising:

an atmospheric pressure ionization source for forming ions from a sample;

an ion transfer tube for transporting ions from the ionization source to a first region, the ion transfer tube extending along a first longitudinal axis;

a partition element separating the first region from a second region, the partition element including a skimmer having a cone-shaped protrusion extending into the first region and an aperture communicating from the first region to the second region for transmitting the ions from the first region to the second region;

a mass analyzer, disposed in a high vacuum region, for measuring the mass-to-charge ratios of at least a portion of the ions, the mass analyzer and the aperture of the partition element lying along a second longitudinal axis that is offset from or at an angle to the first longitudinal axis;

an ion transfer element disposed between the partition element and the mass analyzer, the ion transfer element having an input end for receiving ions that have passed through the aperture of the partition element; and, an ion-deflector at least partially disposed within the second region, the ion-deflector being formed as part of the partition element and having a plurality of electrode surfaces to which a potential difference is applied for establishing an electric field for deflecting ions toward a path approximately along the second longitudinal axis and passing through the input end of the ion transfer element;

wherein, during operation of the mass spectrometer, the second region is maintained at a pressure between 2 and 400 millitorr; and wherein the skimmer comprises two separate skimmer portions that are electrically isolated one from the other, such that application of a potential difference between the two separate skimmer portions establishes the electric field for deflection ions.

2. A mass spectrometer system according to claim 1, wherein the first region is maintained at a pressure between 0.5 and 10 torr during operation of the mass spectrometer.

3. The mass spectrometer system of claim 1, wherein the partition element includes a gas dynamic focusing element for focusing the flow of ions and gases through partition element.

4. An ion transfer assembly for directing ions from an ionization source to a mass analyzer, comprising:

a partition element for separating a first region from a second region, the partition element comprising:

an aperture communicating from the first region to the second region for transmitting ions therebetween, the center of the aperture lying along a longitudinal axis passing through the mass analyzer; and, a skimmer cone formed by two electrode surfaces that are electrically isolated one from the other, the two electrode surfaces disposed in a facing relationship one relative to the other and such that the longitudinal axis passes therebetween; and, an ion transfer element disposed within the second region, the ion transfer element having an input end for receiving ions that have passed through the aperture of the partition element, wherein application of a potential difference between the two electrode surfaces of the partition element results in an electric field being established for deflecting the ions toward the input end of the ion transfer element.

5. An ion transfer assembly according to claim 4, wherein the partition element includes a skimmer having a generally cone-shaped protrusion extending into the first region and terminating at a tip defining the aperture of the partition element, the skimmer bisected by a plane including the longitudinal axis so as to form two separate skimmer portions, and comprising an electrically insulating material disposed within a gap between the two separate skimmer portions for electrically isolating the two separate skimmer portions one from the other, the two electrode surfaces being disposed one each on the two separate skimmer portions.

6. An ion transfer assembly according to claim 4, wherein the partition element includes a skimmer having a generally cone-shaped protrusion extending into the first region and terminating at a tip defining the aperture of the partition element.

7. A method for directing ions from an atmospheric pressure ionization source to a mass analyzer, comprising:

producing ions in an atmospheric ionization source from a sample material;

transferring some of the ions from the ionization source to a first region via a passageway that is in fluid communication with the ionization source, the passageway defining a first longitudinal axis along which the ions travel through the passageway;

sampling some of the ions from the first region into a second region maintained at a pressure between 2 and 400 millitorr via an aperture that is defined through a partition element, the aperture centered about a second longitudinal axis that passes through an ion transfer element within the second region, the second longitudinal axis being laterally or angularly offset with respect to the first longitudinal axis; and, deflecting ions that pass through the aperture of the partition element toward the second longitudinal axis by establishing an electric field that is directed transverse to the first longitudinal axis, such that relatively more ions enter an input end of the ion transfer element compared to when the ions are not deflected;

wherein the deflecting step includes applying a potential difference between two spaced-apart electrode surfaces, the two spaced-apart electrode surfaces being disposed one each on opposite sides of the longitudinal axis, so as to establish the electric field for deflecting ions.

8. A method according to claim 7, wherein the first region is maintained at a pressure between 0.5 and 10 torr.

* * * * *